US008546070B1

(12) United States Patent
Hendricks, III et al.

(10) Patent No.: US 8,546,070 B1
(45) Date of Patent: Oct. 1, 2013

(54) COLOR PHOTOGRAPHIC SILVER HALIDE PAPER AND USE

(71) Applicants: Jess B. Hendricks, III, Rochester, NY (US); Paul L. Zengerle, Rochester, NY (US); Andrew D. Church, Pinner (GB); Darrell B. Austin, Rochester, NY (US)

(72) Inventors: Jess B. Hendricks, III, Rochester, NY (US); Paul L. Zengerle, Rochester, NY (US); Andrew D. Church, Pinner (GB); Darrell B. Austin, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/651,613

(22) Filed: Oct. 15, 2012

(51) Int. Cl.

| | |
|---|---|
| ***G03C 7/26*** | (2006.01) |
| ***G03C 7/46*** | (2006.01) |
| ***G03C 1/08*** | (2006.01) |
| ***G03C 1/494*** | (2006.01) |
| ***G03C 1/06*** | (2006.01) |

(52) U.S. Cl.
USPC ..... 430/546; 430/357; 430/376; 430/377; 430/502; 430/503; 430/543; 430/545; 430/631; 430/905

(58) Field of Classification Search
USPC ..... 430/502, 503, 543, 545, 631, 905, 430/357, 376, 377
See application file for complete search history.

(56) References Cited

U.S. PATENT DOCUMENTS

| | | | | |
|---|---|---|---|---|
| 5,310,639 | A | 5/1994 | Lushington et al. | |
| 5,360,713 | A | 11/1994 | Tang et al. | |
| 5,366,842 | A | 11/1994 | Bagchi et al. | |
| 5,385,815 | A | 1/1995 | Schofield et al. | |
| 5,594,047 | A | 1/1997 | Nielsen et al. | |
| 5,871,894 | A | 2/1999 | Takahashi et al. | |
| 5,962,198 | A | 10/1999 | Lau et al. | |
| 5,962,210 | A | 10/1999 | Hahm et al. | |
| 5,981,159 | A | 11/1999 | Nielsen et al. | |
| 6,153,366 | A | 11/2000 | Arai | |
| 6,218,094 | B1 | 4/2001 | den Zegel et al. | |
| 6,242,172 | B1 | 6/2001 | Budz et al. | |
| 6,280,917 | B1 | 8/2001 | Ueda et al. | |
| 6,783,922 | B2 | 8/2004 | Kluijtmans et al. | |
| 6,838,230 | B2 | 1/2005 | Wan et al. | |
| 7,008,760 | B1 * | 3/2006 | Yoneyama et al. | 430/363 |
| 7,026,107 | B2 | 4/2006 | Shirai | |

* cited by examiner

*Primary Examiner* — Geraldina Visconti
(74) *Attorney, Agent, or Firm* — J. Lanny Tucker

(57) ABSTRACT

A color photographic element has a reflective support and a blue light sensitive color record, a green light sensitive color record, and a red light sensitive color record can be used to provide color photographic prints. The element also has a non-light sensitive interlayer between the green light and red light sensitive color records. This interlayer comprises a hydrophilic colloid and an acrylic latex polymer having a glass transition temperature ($T_g$) of less than 0° C. The presence of this acrylic latex polymer in the interlayer reduces the formation of a cyan line defect when the color photographic print is folded or creased, such as in photobooks.

20 Claims, No Drawings

COLOR PHOTOGRAPHIC SILVER HALIDE PAPER AND USE

FIELD OF THE INVENTION

This invention relates to silver halide color photographic elements that are useful as color photographic papers for providing positive photographic color images. The silver halide color photographic elements exhibit reduced appearance of colored lines or defects when they are folded or creased, for example when displayed in a photobook.

BACKGROUND OF THE INVENTION

The subtractive process of color formation is customarily employed in multi-colored photographic elements. The resulting yellow, magenta, and cyan image dyes are formed in silver halide layers that are sensitive to blue, green, and red radiation, respectively. It is known in the photographic art that these color images are customarily obtained by a coupling reaction between an oxidized aromatic primary amine developer and appropriate color-forming dye image forming color couplers.

A typical silver halide color photographic element contains multiple layers of light-sensitive photographic silver halide emulsions that are sensitized to the appropriate actinic radiation. For example, the appropriate yellow, magenta, and cyan dye images are generally provided in the photographic element as separate blue light sensitive, green light sensitive, and red light sensitive color records comprising the appropriate dye image forming color couplers. Non-light sensitive interlayers are commonly incorporated between adjacent color records in order to reduce color contamination between color records.

Thus, typically, there is a gelatin-containing interlayer between the blue light sensitive color record and the green light sensitive color record, and then another gelatin-containing interlayer between the green light sensitive color record and the red light sensitive color record.

While there has been extensive research relating to the various dye image forming color couplers and other components of the silver halide emulsion layers, there have been only modest efforts to optimize the interlayers for various properties. Typically, the interlayers contain one or more hydrophilic colloids (such as a gelatin), a hardener, and sometimes a non-volatile coupler solvent such as dibutyl phthalate or diunadecyl phthalate, UV absorbers, and oxidized developing agent scavengers such as ballasted hydroquinone or aminophenols as described for example in U.S. Pat. No. 5,962,210 (Hahm et al.).

Latex polymers have been incorporated into photographic elements for various purposes. For example, they have been incorporated into light sensitive silver halide emulsion layers, topmost non-light sensitive overcoat layers, and in backside (non-imaging) layers, of black-and-white and color photographic elements.

U.S. Pat. No. 5,310,639 (Lushington et al.) describes the use of low glass transition temperature polymers in non-light sensitive stress absorbing layers in color negative photographic films to reduce pressure fog while maintaining scratch resistance.

Color silver halide photographic papers or reflective prints have been commonly put into wedding and family albums and on walls and desks for generations. As the industry has wrestled with shrinking volumes and uses of traditional photographic prints, it has found new ways to display and store photographic color prints. One of those ways is what is known as "photobooks" in which one or more reflective color photographs or "prints" are bound and displayed in book form with each image typically covering opposing pages of the photobook. When the photobook is opened, it lies flat with a crease down the middle of the color image.

This crease or fold in the image does not generally create a problem in low density regions of an image, but in the high density (neutral) regions such as gray, black, and dark brown regions of the image, containing significant amount of cyan dye formation, it has been observed that the crease or fold line can show an unwanted cyan-color line. This line can vary in intensity depending upon the method of folding or creasing and the color and density of the image in the fold or crease line. This is an objection or "flaw" in otherwise high quality color photographic prints spread across the two open pages of a photobook.

It is believed that this problem is caused from the force of creasing, folding, and photobook making, which interacts with the series of light-sensitive layers in the color photographic element forming the color print. In particular, it is believed that the fold or crease causes air voids in the cyan dye-containing layer (formed from a red light sensitive silver halide emulsion layer). Once these air voids are formed, light can be reflected back so that the light does not penetrate lower into the photographic print layers to provide accurate color rendition from the combination of magenta, yellow, and cyan dyes in the combination of color dye layers. Because the cyan dye-containing layers are the topmost dye layers in the color photographic prints, the human eye observes only a cyan "defect" in the fold or crease where magenta or yellow dyes are formed in high concentration.

Thus, there is a need to solve this problem in reflective color photographic elements (color prints) so that the color prints can be readily folded or creased with reduced occurrence of the unwanted cyan line defect being seen in the fold or crease line. Solving this problem would make photobooks more attractive to consumers.

SUMMARY OF THE INVENTION

The present invention provides a color photographic element comprising a reflective support, and having on one side thereof and in order from the reflective support:

a blue light sensitive color record comprising a blue light sensitive silver halide emulsion layers comprising a hydrophilic colloid and a yellow dye image forming color coupler, a first non-light sensitive interlayer comprising a hydrophilic colloid, a green light sensitive color record comprising a green light sensitive silver halide emulsion layer comprising a hydrophilic colloid and a magenta dye image forming color coupler, a second non-light sensitive interlayer comprising a hydrophilic colloid, and one or more acrylic latex polymers, each having a glass transition temperature ($T_g$) of less than 0° C., and a red light sensitive color record comprising a light sensitive silver halide emulsion layer comprising a hydrophilic colloid and a cyan dye image forming color coupler.

This invention also provides a method for providing a color photographic print, comprising:

imagewise exposing the color photographic element of any embodiment of this invention to provide an imagewise exposed color photographic element having a latent color positive image, and developing, bleach-fixing, and rinsing the imagewise exposed color photographic element to provide a color positive image from the latent color positive image.

It was found that the present invention solves the problem of the unwanted cyan line defect in the fold or crease lines in reflective color photographic elements (color prints). The present invention solves this problem with a novel chemical composition in the interlayer that is located between the red light sensitive color record and the green light sensitive color record. This change in the interlayer appears to be critical to reducing the air voids that can be formed in fold or crease lines and thus, there is reduced cyan color reflected back to the human eye. It is not certain how the new interlayer composition solves this problem, but without being bound to a specific mechanism, it is likely that the improved interlayer composition is "softer" and provides a more pliable cushion in the resulting reflective color photographic element (color print) especially when it is folded or creased as in open opposing pages of a photobook. The more compliant interlayer may absorb any forces from the crease or fold that would normally rupture the cyan dye-containing silver halide emulsion layer, keeping that layer more intact. As a result of the present invention, the cyan line defect is significantly reduced compared to reflective color photographic elements absent the improved interlayer formulation. The present invention is not directed to what is known as color negative photographic elements (such as color films) that generally have multiple silver halide emulsion layers in each color record that are coated on transparent film supports. Such color negative photographic elements are not designed for photobooks and would not show the cyan line problem described above.

While the improved interlayer formulation is necessary only between the red and green light sensitive color records, for simplicity of manufacturing, the interlayer interposed between the green and blue light sensitive color records can also be changed so that both interlayers in the photographic element can have the same composition. Thus, the improved interlayer composition used in one interlayer does not adversely affect the use of the color photographic element when the same composition is present in the other interlayer.

Further advantages of the present invention can be observed by consideration of the following details of the present invention.

DETAILED DESCRIPTION OF THE INVENTION

Definitions

As used herein to define various components of the layers in the color photographic elements, color photographic developers, and formulations, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Unless otherwise indicated, the terms "color photographic element", "photographic element", "color photographic print", "element" and similar terms are used to refer to embodiments of the present invention.

The term "blue light" generally refers to radiation within the range of at least 400 nm to and including 500 nm.

The term "green light" generally refers to radiation within the range of at least 500 nm to and including 600 nm.

The term "red light" generally refers to radiation within the range of at least 600 nm to and including 700 nm.

The term "high chloride" in referring to silver halide grains and emulsions is used to indicate an overall chloride concentration of at least 80 mol %, based on the total silver in the silver halide grain or emulsion.

In referring to silver halide grains and emulsions containing two or more halides, the halides are named in their order of ascending concentrations.

Silver halide grains and emulsions having named halides can further contain impurity or functionally insignificant levels of one or more unnamed halides (that is, less than 1 mol % based on the total silver).

The term "cubic grain" is used to define a silver halide grain that is bounded by six {100} crystal faces. Typically, the corners and edges of the silver halide grains show some rounding due to ripening, but no identifiable crystal faces other than the six {100} crystal faces. The six {100} faces form three pairs of parallel {100} faces that are equidistantly spaced.

*Research Disclosure* refers to a publication by Kenneth Mason Publications, Ltd., Dudley House, 12 North Street, Emsworth, Hampshire P010 7DQ, England.

Color Photographic Elements

The present invention is directed to a color photographic element comprising a reflective support that can be particularly imaged to provide imaged multicolor prints. In general, such reflective supports include but are not limited to polymeric films that are filled with opacifying agents, cellulosic materials such as papers, and resin-coated papers having a layer of reflective pigment (such as titanium dioxide or barium sulfate).

Disposed on one side of the reflective support, in order, are at least a blue light sensitive color record, a first non-light sensitive interlayer, a green light sensitive color record, a second non-light sensitive layer, and a red light sensitive color record. There can be one or more non-light sensitive layers, such as protective overcoats or UV absorbing layers, disposed over the red light sensitive color record.

Each light sensitive color record comprises one or more silver halide emulsion layers, each silver halide emulsion layer comprising one or more hydrophilic colloids and appropriate dye image forming color couplers, all defined below. In addition, each silver halide emulsion layer also comprises desired silver halide grains and other photographic addenda that provide the desired light sensitivity.

The silver halide emulsion layers used in the present invention generally comprise silver halide grains that comprise at least 50 mol % of chloride and typically they are high chloride silver halide grains or even have at least 80 mol % chloride, or more likely at least 90 mol % chloride, based on total silver. The remaining halide can be bromide or iodide but the silver halide grains generally comprise at least 0.1 mol % to and including 5 mol % of iodide (or up to 2 mol %), based on total silver. Any portion of the halide that is not chloride and iodide is then bromide and such silver halide grains generally have up to 20 mol % bromide, based on total silver.

In many embodiments or the color photographic element of this invention, the blue light sensitive silver halide emulsion layers, green light sensitive silver halide emulsion layers, and red light sensitive silver halide emulsion layers comprise the same or different silver halide grains comprising at least 90 mol % chloride, based on the total grain silver.

In still other embodiments of this invention, each of the blue light sensitive silver halide emulsion layers, green light sensitive silver halide emulsion layers, and red light sensitive silver halide emulsion layers comprise the same or different silver halide grains comprising at least 95 mol % chloride, based on the total grain silver.

In other embodiments of this invention, each of the blue light sensitive silver halide emulsion layers, green light sensitive silver halide emulsion layers, and red light sensitive silver halide emulsion layers comprise the same or different silver halide grains comprising at least 90 mol % chloride, and up to 2 mol % of iodide, both based on the total grain silver.

In most embodiments, each of the color records comprises a single silver halide emulsion layer.

Most likely, the color photographic elements of this invention comprise:

a blue light sensitive color record that comprises a single blue light sensitive silver halide emulsion layer comprising a gelatin as the hydrophilic colloid, one or more yellow dye image forming color couplers, and silver halide grains having at least 95 mol % chloride and up to 2 mol % of iodide, based on the total grain silver, a green light sensitive color record that comprises a single green light sensitive silver halide emulsion layer comprising a gelatin as the hydrophilic colloid, one or more magenta dye image forming color couplers, and silver halide grains having at least 95 mol % chloride and up to 2 mol % of iodide, based on the total grain silver, and a red light sensitive color record that comprises a single red light sensitive silver halide emulsion layer comprising a gelatin as the hydrophilic colloid, one or more cyan dye image forming color couplers, and silver halide grains having at least 95 mol % chloride and up to 2 mol % of iodide, based on the total grain silver.

Useful silver halide grains and methods for making them, with and without specific dopants (such as iridium, osmium, ruthenium, or rhodium complex dopants), and useful chemical and spectral sensitizers, are known in the art and described for example in U.S. Pat. No. 5,962,210 (Hahm et al.) and U.S. Pat. No. 6,242,172 (Budz et al.), both incorporated herein by reference, and in *Research Disclosure*, Item 38957 published September 1996 and Item 437013 published September 2000. In most embodiments, the silver halide grains used in the silver halide emulsion layers are cubic silver halide grains. The silver halide emulsions can be prepared to have silver halide grains in any mean grain size known to be useful. Mean grain sizes are generally in the range of at least 0.15 vim to and including 2.5 μm. Gold and sulfur chemical sensitizers are generally used to improve photographic speed and to reduce fogging. The silver halide grains can be sensitized using dyes from a variety of classes including but not limited to polymethine dyes such as cyanines and merocyanines, styryls, merostyryls, stretocyanines, hemicyanines, arylidenes, allopolar cyanines, and enamine cyanines. Combinations of spectral sensitizing dyes can be used for what is known as supersensitization as described for example by Gilman, *Photographic Science and Engineering*, Vol. 18, 1974, pp. 418-430.

Each silver halide emulsion layer can comprise one or more different silver halide emulsions (a blended emulsion layer), each silver halide emulsion comprising suitable silver halide grains of a defined halide composition, and various addenda. Thus, the one or more of the silver halide emulsion layers can comprise a mixture of different silver halide grains, or they can comprise essentially the same silver halide grains uniformly distributed throughout the layer.

The amount of silver in the color photographic element of this invention can vary depending upon its use, desired sensitivity, and other features known in the art. In general, the color photographic element comprises less than 2000 mg/m$^2$ of total silver and this amount is divided among the silver halide emulsion layers. In many embodiments, the amount of total silver is at least 100 mg/m$^2$ to and including 1200 mg/m$^2$. It is not usual that the amount of silver is the same in each silver halide emulsion layer. In general, the amount of silver in the blue light sensitive color record is less than 500 mg/m$^2$, the amount of silver in the green light sensitive color record is less than 200 mg/m$^2$, and the amount of silver in the red light sensitive color record is less than 500 mg/m$^2$.

The hydrophilic colloids useful in the present invention can be the same or different in the various layers. Useful hydrophilic colloids include but are not limited to, gelatin and modified gelatins (also known as gelatin derivatives) including acetylated gelatin, phthalated gelatin, and other naturally occurring and synthetic hydrophilic materials that are known in the art. Such materials can also be readily hardened using known hardeners as is common practice in the photographic art to reduce the absorption of water during processing of the imaged elements.

In most embodiments, the silver halide emulsion layers and non-light sensitive layers generally comprise a gelatin or gelatin derivative as the hydrophilic colloid that can be modified using one or more hardeners. These silver halide emulsion layers can also include various vehicles, vehicle extenders, and other addenda known in the art, for example as described in the *Research Disclosure* publication noted above.

The various light sensitive color records used in the color photographic elements also comprise one or more dye image forming color couplers, specific to the light sensitivity and color desired for a given color record. Thus, the blue light sensitive color record comprises one or more yellow dye image forming color couplers, the green light sensitive color record comprises one or more magenta dye image forming color couplers, and the red light sensitive color record comprises one or more cyan dye image forming color couplers. In any of the color records, the one or more dye image forming color couplers can be present in the same or different silver halide emulsion layer. In most embodiments, each color record comprises a single silver halide emulsion layer containing all dye image forming color couplers ("couplers") needed for that color record. These dye image forming color couplers form appropriate image dyes upon reaction with oxidized color developing agent provided during photographic processing.

Coupling-off groups can determine the chemical equivalency of a coupler, that is, whether it is a 2-equivalent or a 4-equivalent coupler, or to modify the reactivity of the coupler. Such groups can advantageously affect the silver halide emulsion layer in which the image-forming coupler is located, or other layers in the color photographic element, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766, the disclosure of which are incorporated herein by reference, and in GB published applications 1,466,728, 1,531,927, 1,533,039, 2,006,755A and 2,017,704A.

Dye image forming color couplers that form cyan dyes upon reaction with oxidized color developing agents are described for example, in U.S. Pat. Nos. 2,367,531, 2,423,730, 2,474,293, 2,772,162, 2,895,826, 3,002,836, 3,034,892, 3,041,236, 4,333,999, 4,883,746, and 5,256,526 all of which are incorporated herein by reference, and in "Farbkuppler-eine LiteratureUbersicht," published in Agfa Mitteilungen, Band III, pp. 156-175 (1961). Usually such dye image forming color couplers are phenols, naphthols, and pyrazolotriazoles that form cyan dyes upon reaction with oxidized color developing agent. Other useful cyan dye image-forming couplers are described in U.S. Pat. No. 7,153,640 (Zengerle et al.) that is incorporated herein by reference.

Dye image forming color couplers that form magenta dyes upon reaction with oxidized color developing agent are described in U.S. Pat. Nos. 2,311,082, 2,343,703, 2,369,489, 2,600,788, 2,908,573, 3,062,653, 3,152,896, 3,519,429, 3,758,309, and 4,540,654, all of which are incorporate herein by reference, and in "Farbkuppler-eine LiteratureUbersicht," published in Agfa Mitteilungen, Band III, pp. 126-156 (1961). Usually such dye image forming color couplers are pyrazolones, pyrazolotriazoles, or pyrazolobenzimidazoles that form magenta dyes upon reaction with oxidized color developing agents.

Dye image forming color couplers that form yellow dyes upon reaction with oxidized and color developing agent are described in U.S. Pat. Nos. 2,298,443, 2,407,210, 2,875,057, 3,048,194, 3,265,506, 3,447,928, 4,022,620, 4,443,536, 4,840,884, 5,447,819, 5,457,004, 5,998,121, 6,132,944, and 6,569,612, all of which are incorporated herein by reference, and in "Farbkuppler-eine LiteratureUbersicht," published in Agfa Mitteilungen, Band III, pp. 112-126 (1961). Such dye image forming color couplers are typically open chain ketomethylene compounds.

U.S. Pat. No. 5,962,210 (noted above) is also incorporated herein by reference to provide further details about cyan, magenta, and yellow dye image forming color couplers that are useful in the present invention.

These dye image forming color couplers can be incorporated into the various silver halide emulsion layers in amounts that are known in the art.

Polymer containing dye image forming color couplers compositions or dispersions can be prepared by emulsifying a mixed oil emulsion containing a suitable coupler solvent and the dye image forming color coupler(s).

Typically, dye image forming color couplers are incorporated into each silver halide light sensitive emulsion layers in a mole ratio to silver of at least 0.05:1 and up to and including 1:1, or typically at least 0.1:1 and up to and including 0.5:1. Usually the dye image forming color couplers are incorporated as dispersions in one or more hydrophobic organic solvents (sometimes called "permanent" solvents, "high boiling" coupler solvents), in a weight ratio of coupler solvent to image-forming coupler of at least 0.1:1 and up to and including 10:1, and typically of at least 0.1:1 and up to and including 2:1 although dispersions using no coupler solvent are sometimes employed.

A dye image forming color coupler dispersion contains one or more dye image forming color couplers in a stable, finely divided state in a coupler solvent that is stabilized by suitable surfactants or surface active agents usually in combination with a binder or matrix such as gelatin or a gelatin derivative. The dispersion can contain one or more coupler solvents that dissolve the materials and maintain them in a liquid state. Some examples of suitable coupler solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Useful classes of coupler solvents are carbonamides, phosphates, phenols, alcohols, and esters. When a coupler solvent is present in the silver halide emulsion layer, it is usual that the weight ratio of dye image forming color coupler to coupler solvent of at least 1:0.5, or at least 1:1. The dispersion can contain an auxiliary coupler solvent initially to dissolve the dye image forming color coupler but this auxiliary coupler solvent is removed afterwards, usually either by evaporation or by washing with additional water. Some examples of suitable auxiliary coupler solvents are ethyl acetate, cyclohexanone and 2-(2-butoxyethoxy)ethyl acetate. The dispersion can also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC, sodium dodecyl benzene sulfonate, and saponin. The dye image forming color couplers can also be dispersed as an admixture with another component of the system such as a dye image forming color coupler or an oxidized developer scavenger so that both are present in the same oil droplet. It is also possible to incorporate the dye image forming color couplers as a solid particle dispersion; that is, a slurry or suspension of finely ground (through mechanical means) compound. These solid particle dispersions can be additionally stabilized with surfactants or polymeric materials as known in the art. Additional coupler solvents can be added to the solid particle dispersion to help increase activity. Polymers that can be used in color coupler dispersions are described in U.S. Pat. No. 5,962,210 (noted above) that is incorporated herein by reference.

The term "high boiling organic solvent" is used herein to refer to coupler solvents having a boiling point above about 150° C. Such coupler solvents have sufficient carbon atoms so that they have a sufficient molecular weight to prevent excessive solvent migration between layers in the element. The coupler solvents are also liquids at 37° C. that is a typical processing (development) temperature. Particularly useful high boiling coupler solvents include tricresylphosphate, N,N-diethyllauramide, N,N-dibutyllauramide, p-dodecylphenol, dibutylphthalate, di-n-butyl sebacate, 2-hexyl-1-decanol, tri(2-ethylhexyl)phosphate, 2,4-di-t-pentylphenol, and triphenylphosphate. Mixtures of high boiling organic solvents are also useful. Other useful coupler solvents are described in U.S. Pat. No. 4,540,657 (Krishnamurthy), U.S. Pat. No. 4,684,606 (Krishnamurthy), and U.S. Pat. No. 5,405,736 (Young) all of which are incorporated herein by reference.

Each silver halide emulsion layer of the color photographic element can also have useful dye hue modifiers and image dye stabilizers as described in the *Research Disclosure* publications noted above.

The color photographic element can include one or more non-light sensitive protective overcoats disposed over the red light sensitive color record. Such non-light sensitive protective overcoats are generally transparent and can also comprise one or more hydrophilic gelatin colloids, vehicles, and other addenda commonly employed for various purposes, such as ultraviolet light absorbers, optical dyes or brighteners, particulate matting agents, plasticizers, lubricants, surfactants, and antistatic agents, all of which are also described in the noted Research Disclosure publications.

Interlayers

The color photographic elements generally comprise one or more non-light sensitive interlayers disposed between two adjacent color records. Thus, a first non-light sensitive interlayer is present between the blue light sensitive color record and the green light sensitive color record, and a second non-light sensitive interlayer if present between the green light sensitive color record and the red light sensitive color record.

Such non-light sensitive interlayers generally include one or more oxidized color developing agent scavengers (such as ballasted hydroquinones or aminophenols), ultraviolet absorbers, or both types of compounds. The amounts of such compounds are well known in the art.

In addition, each non-light sensitive interlayer has one or more hydrophilic colloids (such as a gelatin) present in an amount sufficient to provide a total dry layer coverage of at least 200 mg/m$^2$, or at least 200 mg/m$^2$ to and including 2,000 mg/m$^2$. Useful hydrophilic colloids, such as gelatin and gelatin derivatives, are known in the art, as described above for the silver halide emulsion layers.

More importantly, at least the second non-light sensitive interlayer comprises one or more acrylic latex polymers, in a total dry amount of at least 20 mg/m$^2$ to and including 2,000 mg/m$^2$, and typically in a total dry amount of at least 50 mg/m$^2$ to and including 500 mg/m$^2$.

It is also useful, especially in the second non-light sensitive interlayer, that the dry weight ratio of the hydrophilic colloid (such as a gelatin) to one or more acrylic latex polymers is at least 2.25:1 and up to and including 12:1, or typically at least 3:1 to and including 10:1.

In general, the acrylic latex polymers useful in this manner, especially in the second non-light sensitive interlayer, have a glass transition temperature ($T_g$) of at least −80° C. and less than 0° C., or more typically of at least −50° C. and to and including −10° C. Each of the acrylic latex polymers has a $T_g$ within this range, but if a mixture of acrylic latex polymers is used, the mixture has a composite $T_g$ within the noted range even if one or more of the acrylic latex polymers has an individual $T_g$ outside the range. A skilled worker would know how to adjust the acrylic latex polymers in the mixture to achieve the desired composite $T_g$. For purposes of this invention, the glass transition temperature of the acrylic latex polymers can be determined using Differential Scanning calorimetry. Some polymer glass transition temperature values are known in the literature.

Each of the acrylic latex polymers useful in the practice of this invention generally comprises at least 50 weight % of recurring units (or repeating units) derived from one or more acrylic esters or methacrylic esters, based on the total dry weight of the recurring units. The acrylic ester monomers used for providing these recurring units can be conveniently provided by reacting acrylic acid or methacrylic acid with an alcohol, phenol, or hydroxy substituted ether. The useful polymerizable acrylates generally have up to 20 carbon atoms in the ester groups, or from 1 to 10 carbon atoms, or more likely 2 to 6 carbon atoms.

The acrylic latex polymers can comprise two or more different types of recurring units, in random order, and as noted above, more than 50 weight %, and typically at least 80 weight %, or even at least 90 weight %, of the recurring units are derived from one or more acrylic or methacrylic acid ester ethylenically unsaturated polymerizable monomers. In particular, the acrylic acid or methacrylic acid esters that are capable of providing homopolymers having a $T_g$ of less than 0° C. are useful.

Examples of useful ethylenically unsaturated polymerizable monomers of this type are described for example, in Columns 4 and 5 of U.S. Pat. No. 5,310,639 (noted above) that is incorporated herein by reference.

Other useful ethylenically unsaturated polymerizable monomers that can provide up to 50 weight %, or up to 20 weight %, or even up to 10 weight % of the total weight of recurring units can be any of those monomers described in Cols. 5-9 of U.S. Pat. No. 5,310,639 (noted above).

More particularly, the acrylic latex polymer useful in the second interlayer is a copolymer that comprises recurring units derived from at least one of each of the following (a) and (b) groups of ethylenically unsaturated polymerizable monomers, and optionally at least one (c) group of ethylenically unsaturated polymerizable monomers:

(a) At least one acrylate monomer having an alkyl group having 2 to 6 carbon atoms, such ethyl acrylate, ethyl methacrylate, propyl acrylate, propyl methacrylate, isopropyl acrylate, isopropyl methacrylate, n-butyl acrylate, n-butyl methacrylate, 2-hydroxyethyl methacrylate, and others that would be readily apparent to one skilled in the art, for example as described in U.S. Pat. No. 5,310,639 (noted above).

(b) An ethylenically unsaturated polymerizable monomers such as acrylic acid and methacrylic acid esters, or acrylamides or methacrylamides, having a pendant sulfo or oxosulfo groups, or salts thereof, such as 2-acrylamido-2-methylpropane sulfonic acid, sodium salt, 2-acrylamido-2-methylpropane sulfonic acid, 2-acrylamido-2-methylbutane sulfonic acid, 2-acrylamido-2-methylbutane sulfonic acid, sodium salt, 2-acrylamido-2-methylpropane sulfonic acid, potassium salt, 2-acrylamido-2-propane sulfonic acid, and 2-acrylamido-2-propane sulfonic acid, sodium salt, and other monomers that would be readily apparent to one skilled in the art, for example as described in Cols. 6 and 7 of U.S. Pat. No. 5,310,639 (noted above).

(c) An acetoacetoxy acrylate or acetoacetoxy methacrylate, such as 2-(acetoacetoxy)ethyl methacrylate, 2-(acetoacetoxy)methyl methacrylate, 2-(acetoacetoxy) propyl methacrylate, 2-(acetoacetoxy) butyl methacrylate, 2-(acetoacetoxy)methacrylate, 2-(acetoacetoxy) propyl acrylate, 2-(acetoacetoxy) butyl acrylate, ethylene glycol dimethacrylate, and other monomers that would be readily apparent to one skilled in the art.

A skilled worker in the art would be able to craft the appropriate copolymers from various monomers to obtain the desired glass transition temperatures so the copolymers can be used to solve the cyan line defect described herein.

In some embodiments, the useful acrylic latex polymers comprises at least 80 mol % of recurring units derived from one or more (a) group monomers, at least 4 mol % of recurring units derived from one or more (b) group monomers, and optionally up to, and preferably, at least 2 mol % of recurring units derived from one or more (c) group monomers, all based on the total recurring units in the copolymer. The copolymer is not required to contain recurring units from the (c) group monomers.

More typically, the acrylic latex polymer comprises at least 85 mol % to and including 95 mol % of recurring units derived from one or more (a) group monomers, at least 4 mol % to and including 7 mol % of recurring units derived from one or more (b) group monomers, and at least 2 mol % to and including 6 mol % of recurring units derived from one or more (c) group monomers, based on the total recurring units in the copolymer.

Representative useful acrylic latex polymers are described below in the Invention Examples. Useful monomers for preparing the acrylic latex polymers can be readily purchased from commercial sources, and making the acrylic latex polymers is achievable using known emulsion polymerization conditions and starting materials.

The same or different acrylic latex polymer can be present in the first non-light sensitive interlayer described for the color photographic elements. In some embodiments, both first and second non-light sensitive interlayers comprise the same acrylic latex polymer or mixture of acrylic latex polymers.

It has also been found that further improvements can be provided when the first or second (or both) non-light sensitive interlayers also comprise one or more high boiling organic coupler solvents in a total high boiling organic coupler solvent amount greater than 100 mg/m$^2$, based on the total non-light sensitive interlayer dry weight. More particular, the second non-light sensitive interlayer further comprises one or more high boiling organic coupler solvent in an amount of at least 100 mg/m$^2$ to and including 1000 mg/m$^2$, or more likely at least 125 mg/m$^2$ to and including 500 mg/m$^2$, based on total non-light sensitive interlayer dry weight. The weight ratio of hydrophilic colloid to high boiling organic coupler solvent is generally at least 1:1 and typically at least 2:1 in each non-light sensitive interlayer.

Such high boiling coupler solvents include one or more carbonamides, phosphates, phenols, alcohols, or esters, and particularly useful high boiling coupler solvents are described above in relation to the silver halide emulsion layers.

The first non-light sensitive interlayer can also comprise one or more high boiling organic coupler solvents in a total amount of at least 100 mg/m$^2$, based on the total dry interlayer weight. In addition, such first non-light sensitive interlayers can also comprise an acrylic latex copolymer, as described above, having a glass transition temperature ($T_g$) of at least −80° C. and less than 0° C.

Useful high boiling organic coupler solvents can be purchased from a number of commercial sources.

The color photographic elements of this invention can be provided as a number of commercial products including but not limited to, color papers that are commercially available from Eastman Kodak Company include but are not limited to EKTACOLOR EDGE and ENDURA™ Premier Color Papers, KODAK Photobook Papers, as well as FUJICOLOR Crystal Archive Color Papers (available from Fujifilm). However, the color photographic elements can be modifications of any of these commercial products to achieve the desired benefit of reducing the cyan line problem described above.

Processing Conditions and Solutions

The color photographic elements of this invention can be suitably imaged by exposure to any suitable analog or digital source of radiation. For example, analog exposure can be provided by a suitable lamp such as a tungsten lamp. A digital means for exposure includes a digital writer comprising a laser, light emitting diode (LED) beam, or cathode ray tube (CRT) of appropriate spectral radiation to which the color photographic element is sensitive to provide an imagewise exposed color photographic element having a latent color positive image. Imagewise exposure at ambient, elevated or reduced temperatures or pressures can be used within the useful response range of the color photographic element determined by known sensitometric techniques and equipment. Some useful digital exposure means and procedures are described in U.S. Pat. No. 6,838,230 (Wan et al.) that is incorporated herein by reference.

Once imagewise exposed, the imagewise exposed color photographic element is "processed" to provide a color positive image from the latent color positive image. Processing is a well known procedure and there are a number of suitable processing chemistries available to one skilled in the art including KODAK EKTACOLOR RA-4 processing chemistry that include color development using a suitable color developing solution containing a color developing agent, fixing using a fixing solution, and rinsing the final color print. Each processing chemistry is used at recommended times and temperatures for the given steps, which conditions would be readily known to one skilled in the art. Other processing conditions and chemistry is described for example, in U.S. Pat. No. 6,077,651 (Darmon et al.), U.S. Pat. No. 6,228,567 (Darmon et al.), U.S. Pat. No. 6,428,946 (Buongiorne et al.), U.S. Pat. No. 6,664,036 (Darmon et al.), U.S. Pat. No. 6,838,230 (noted above), and U.S. Pat. No. 7,118,850 (Fujita et al.), and U.S. Patent Application 2001/0055734 (Tappe et al.), all of which are incorporated herein by reference.

After processing to form color photographic prints, the resulting color positive image can be used in any suitable manner, including assembling it image into a photobook, with or without other color positive images.

Alternatively, the resulting color positive image can be electronically transmitted or displayed using various electronic or display devices for storage, viewing, or image manipulation.

The following Examples are provided to illustrate the practice of this invention and are not meant to be limiting in any manner.

Invention Example 1

Color photographic element 101 was prepared by coating the following layers on a corona discharge-treated, polyethylene-coated paper support (all amounts are dry coverage):

| | mg/m$^2$ |
|---|---|
| Layer 1 (Blue light-sensitive silver halide emulsion layer): | |
| Blue light sensitive silver halide emulsion AG-1 (3D 0.60 μm, $AgCl_{0.998}I_{0.002}$, grains having sensitizing dye SD-1) | 245.0 |
| Yellow coupler Y-1 | 570.5 |
| Light stabilizer ST-1 | 105.4 |
| Light stabilizer ST-2 | 105.4 |
| Light stabilizer ST-3 | 105.4 |
| Coupler solvent S-1 | 300.1 |
| Gelatin | 1293.2 |
| Layer 2 (First Interlayer): | |
| Dox scavenger D-1 | 139.9 |
| Coupler solvent S-2 | 209.9 |
| Gelatin | 816.0 |

-continued

| | mg/m$^2$ |
|---|---|
| Layer 3 (Green light-sensitive silver halide emulsion layer): | |
| Green light sensitive silver halide emulsion AG-2 (3D 0.35 μm, AgCl, grains having sensitizing dye SD-2) | 93.1 |
| Magenta coupler M-1 | 193.8 |
| Light stabilizer ST-3 | 15.1 |
| Coupler solvent S-2 | 302.7 |
| Coupler solvent S-3 | 220.4 |
| Coupler solvent S-4 | 82.3 |
| Gelatin | 1245.9 |
| Layer 4 (Second Interlayer): | |
| $D_{ox}$ scavenger D-1 | 129.2 |
| Coupler solvent S-2 | 193.8 |
| Gelatin | 753.5 |
| Layer 5 (Red light-sensitive silver halide emulsion layer): | |
| Red light sensitive silver halide emulsion AG-3 (3D 0.40 μm, AgCl, grains having sensitizing dye SD-3) | 111.0 |
| Cyan coupler C-1 | 175.4 |
| Cyan coupler C-2 | 87.7 |
| Light stabilizer ST-4 | 79.4 |
| UV absorber UV-1 | 304.7 |
| Coupler solvent S-2 | 640.9 |
| Coupler solvent S-5 | 71.2 |
| Gelatin | 1851.0 |
| Layer 6 (UV absorbing layer): | |
| UV absorber UV-1 | 152.8 |
| Coupler solvent S-6 | 71.8 |
| Gelatin | 484.4 |
| Layer 7 (Overcoat layer): | |
| Polydimethylsiloxane | 20.2 |
| Ludox ™ (colloidal silica) | 242.2 |
| Gelatin | 565.1 |

The various coatings further contained sequestering agents, antifoggants, surfactants, and matte beads as known in the art. The gelatin-containing layers were hardened using bis(vinylsulfonyl methyl)ether at 2.15% of the total gelatin weight.

The various components are identified as follows:

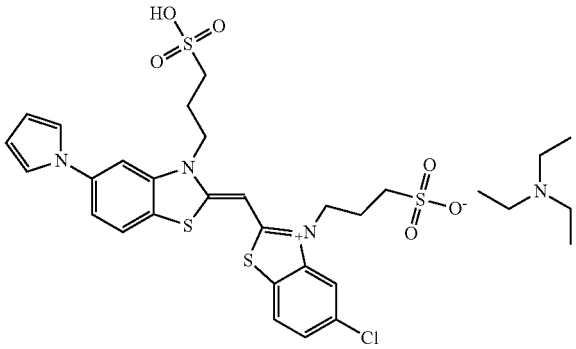

Sensitizing dye SD-1

-continued

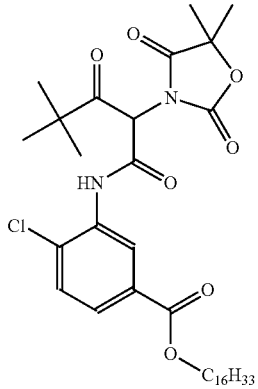

Yellow coupler Y-1

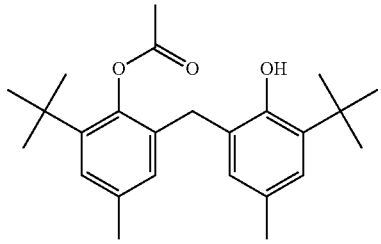

Light stabilizer ST-1

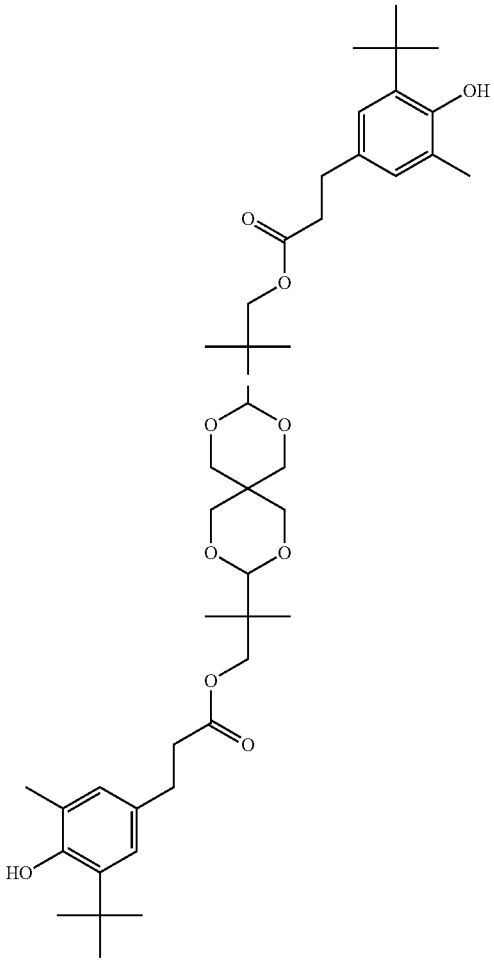

Light stabilizer ST-2

-continued
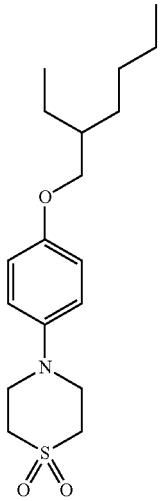
Light stabilizer ST-3
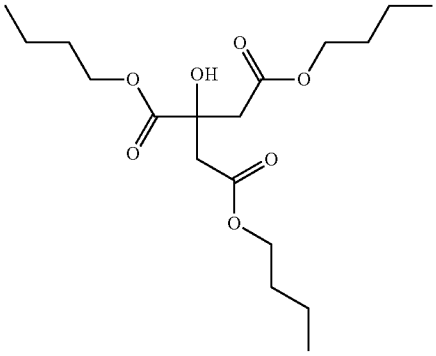
Coupler solvent S-1
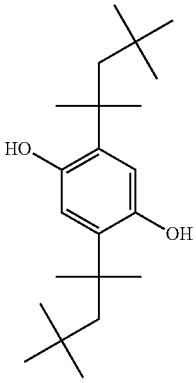
$D_{ox}$ Scavenger D-1
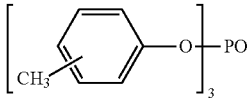
Coupler solvent S-2
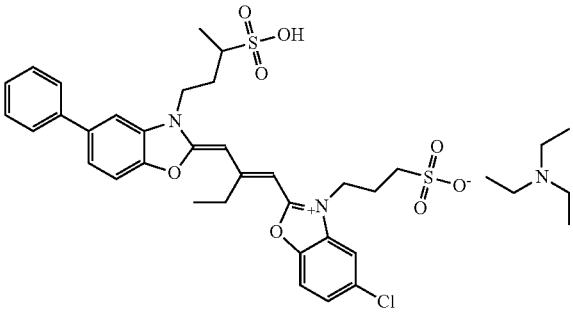
Sensitizing dye SD-2
-continued
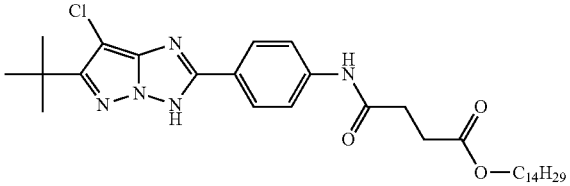
Magenta coupler M-1
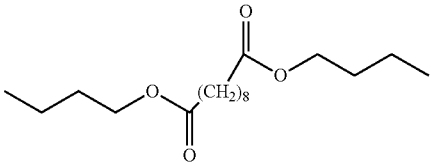
Coupler solvent S-3
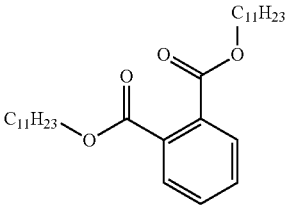
Coupler solvent S-4
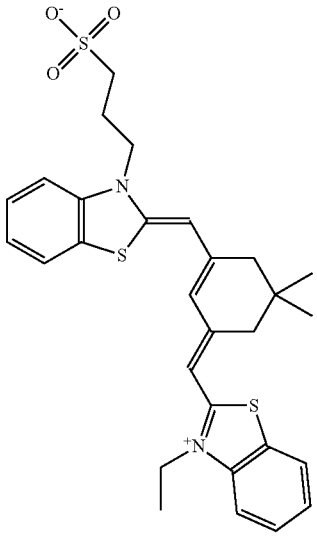
Sensitizing dye S-3

-continued

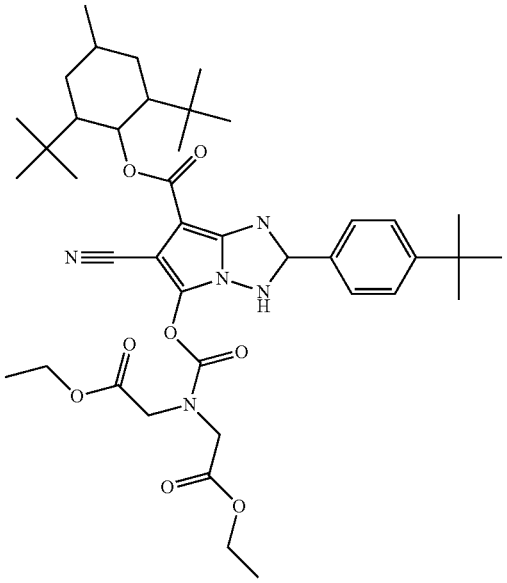

Cyan coupler C-1

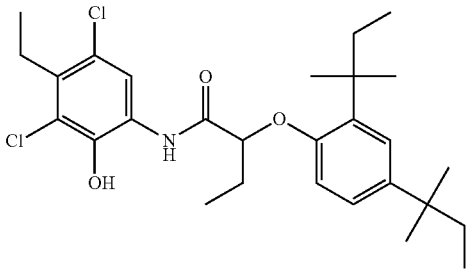

Cyan coupler C-2

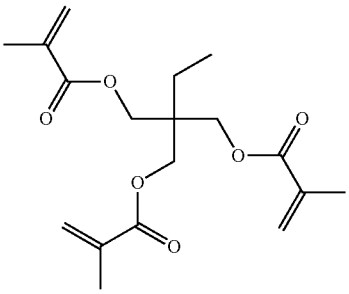

Light stabilizer ST-4

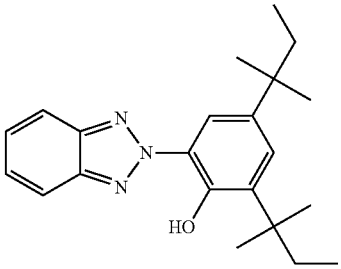

UV absorber UV-1

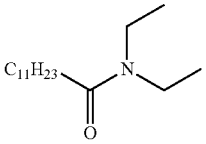

Coupler solvent S-5

-continued

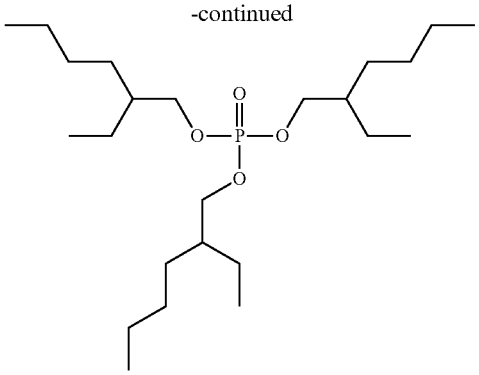

Coupler solvent S-6

Polymer P-1 was an acrylic latex copolymer derived by polymerization of n-butyl acrylate, 2-acetoacetoxy ethyl methacrylate, and 2-acrylamido-2-methylpropane sulfonic acid sodium salt (0.90/0.04/0.06 molar ratio), $T_g$=−40° C.

Polymer P-2 was an acrylic latex copolymer derived by polymerization of n-butyl acrylate, styrene, methacrylamide, and 2-acrylamido-2-methylpropane sulfonic acid sodium salt (0.59/0.25/0.08/0.08 molar ratio), $T_g$=0° C.

Polymer P-3 was an acrylic latex copolymer derived from polymerization of ethyl methacrylate and 2-acrylamido-2-methylpropane sulfonic acid sodium salt (0.95/0.05 molar ratio), $T_g$=75° C.

Color photographic elements 102 through 107 were similarly prepared except that latex polymer P-1 was added to various layers as described in TABLE I below.

Samples of each color photographic element were image-wise exposed to white light and processed using known Kodak EKTACOLOR RA-4 processing chemistry (color development, fixing, and rinsing) as described in the *British Journal of Photography Annual of* 1988, pp 198-199 to achieve a uniform neutral $D_{max}$ image. Each imaged and processed sample (color print) was then creased using a commercial creasing device and then folded as is commonly done when such color prints are put into a photobook. Samples 1 and 2 were made with each creased and folded color photographic element. After having been creased and folded for at least 24 hours at room temperature, each finished sample was then visually examined for the appearance of cyan colored lines in the areas where the color print had been creased and folded and was given a rating based on the scale of 1 to 5, where 5 represents an intensely cyan colored line in the fold line and 1 represents a fold line that has no color at all. The results are provided in the last two columns of TABLE I below.

TABLE I

Cyan Line Ratings for Creased and Folded Samples 1 and 2 (Polymer P-1 levels in mg/m$^2$)

| Element | Layer 5 | Layer 4 | Layer 3 | Layer 2 | Layer 1 | Sample 1 | Sample 2 |
|---|---|---|---|---|---|---|---|
| 101 | | | | | | 5 | 5 |
| 102 | | 387.6 | | 419.7 | | 2 | 2 |
| 103 | 300 | | | | | 5 | 5 |
| 104 | 300 | 300 | | 300 | | 2 | 2 |
| 105 | 300 | 300 | 300 | 300 | | 1.5 | 1.5 |
| 106 | 300 | 300 | 300 | 300 | 300 | 1.5 | 1.5 |
| 107 | | | | | | 5 | 5 |

The results shown in TABLE I indicate that a substantial improvement in cyan line appearance was obtained with each color photographic element of the present invention that contained acrylic latex Polymer P-1 in Layer 2 (first interlayer) and Layer 4 (second interlayer).

Invention Example 2

Color photographic elements 108 through 125 were similarly prepared, processed, and evaluated as previously described above for Invention Example 1. A description of the coating variations and the results of cyan line evaluations after the color prints were formed are given below in TABLE II.

TABLE II

Cyan Line Ratings for Creased and Folded Samples 1 and 2

| Element | Description | Sample 1 | Sample 2 |
|---|---|---|---|
| 108 | Like Element 101 | 5 | 5 |
| 109 | Like Element 108 | 5 | 5 |
| 110 | Like Element 109 except Layer 7 had gelatin at 1130.2 mg/m$^2$ | 5 | 5 |
| 111 | Like Element 109 except Layer 6 had gelatin at 968.8 mg/m$^2$ | 4 | 5 |
| 112 | Like Element 111 except Layer 7 had gelatin at 1130.2 mg/m$^2$ and Layer 4 had gelatin at 1507 mg/m$^2$ | 5 | 5 |
| 113 | Like Element 112 except Layer 5 had gelatin at 3702 mg/m$^2$ | 5 | 5 |
| 114 | Like Element 108 except added Polymer P-1 to Layer 4 at 600 mg/m$^2$ | 3 | 2.5 |
| 115 | Like Element 114 except added Polymer P-1 to Layer 6 at 600 mg/m$^2$ and to Layer 7 at 600 mg/m$^2$ | 3 | 2.5 |
| 116 | Like Element 108 except added Polymer P-2 to Layer 4 at 600 mg/m$^2$ | 5 | 5 |
| 117 | Like Element 116 except added Polymer P-2 to Layer 6 at 600 mg/m$^2$ and to Layer 7 at 600 mg/m$^2$ | 5 | 3 |
| 118 | Like Element 108 except added Polymer P-3 to Layer 4 at 600 mg/m$^2$ | 5 | 5 |
| 119 | Like Element 118 except added Polymer P-3 to Layer 6 at 600 mg/m$^2$ and to Layer 7 at 600 mg/m$^2$ | 4 | 5 |
| 120 | Like Element 108 except added Polymer P-3 to Layer 7 at 600 mg/m$^2$ | 4 | 5 |
| 121 | Like Element 108 except omitted D-1 and S-2 from Layer 4 | 5 | 5 |
| 122 | Like Element 121 except Layer 4 had gelatin at 1507 mg/m$^2$ | 5 | 5 |
| 123 | Like Element 108 except added UV-1 & UV-2 to Layer 4 at 129.9 mg/m$^2$ and 22.9 mg/m$^2$, respectively | 4 | 5 |
| 124 | Like Element 108 except added Polymer P-2 to Layer 5 at 600 mg/m$^2$ | 4 | 3 |
| 125 | Like Element 108 except added Polymer P-3 to Layer 5 600 mg/m$^2$ | 5 | 5 |

The results shown in TABLE II indicate that a substantial improvement in cyan line appearance was obtained only when acrylic latex Polymer P-1, having a glass transition temperature of −40° C., was used in Layer 4 (second interlayer). Acrylic latex polymers P-2 and P-3, with much higher glass transition temperatures, were not effective when added to Layer 4 to solve the cyan line problem.

Invention Example 3

Color photographic elements 126 through 143 were similarly prepared, processed, and evaluated as previously described in Invention Example 1. These color photographic elements featured changes in the levels (mg/m$^2$) of acrylic latex polymer P-1 and coupler solvent S-2 in Layers 2 (first interlayer) and 4 (second interlayer). Descriptions of the coating variations and results of cyan line evaluations are given below in TABLE III.

TABLE III

Cyan Line Ratings for Creased and Folded Samples 1 and 2

| Element | Layer 4 P-1 | Layer 4 S-2 | Layer 2 P-1 | Layer 2 S-2 | Sample 1 | Sample 2 |
|---|---|---|---|---|---|---|
| 126 | 0 | 193.8 | 0 | 209.9 | 5 | 5 |
| 127 | 0 | 364.5 | 0 | 395.2 | 3.5 | 4 |
| 128 | 0 | 407.8 | 0 | 441.6 | 3.5 | 3 |
| 129 | 0 | 450.6 | 0 | 487.9 | 2 | 3 |
| 130 | 0 | 493.4 | 0 | 534.3 | 2.5 | 2.5 |
| 131 | 0 | 536.2 | 0 | 580.6 | 2.5 | 2.5 |
| 132 | 0 | 450.6 | 0 | 487.9 | 3.5 | 4 |
| 133 | 0 | 493.4 | 0 | 534.3 | 3 | 4 |
| 134 | 0 | 536.2 | 0 | 580.6 | 3.5 | 3 |
| 135 | 0 | 450.6 | 0 | 487.9 | 4 | 4 |
| 136 | 0 | 493.4 | 0 | 534.3 | 4 | 4 |
| 137 | 0 | 536.2 | 0 | 580.6 | 2 | 4 |
| 138 | 200 | 193.8 | 217 | 209.9 | 3 | 3 |
| 139 | 200 | 536.2 | 217 | 580.6 | 2 | 2 |
| 140 | 200 | 364.5 | 217 | 395.2 | 3.5 | 3 |
| 141 | 100 | 536.2 | 108 | 580.6 | 2 | 2 |
| 142 | 100 | 364.5 | 108 | 395.2 | 2.5 | 2.5 |
| 143 | 0 | 193.8 | 0 | 209.9 | 5 | 5 |

The results in TABLE III show that the greatest improvement in cyan line appearance was obtained when the highest levels of coupler solvent S-2 were employed in combination with acrylic latex polymer P-1 in Layer 4 (second interlayer).

The invention has been described in detail with particular reference to certain preferred embodiments thereof, but it will be understood that variations and modifications can be effected within the spirit and scope of the invention.

The invention claimed is:

1. A color photographic element comprising a reflective support, and having on one side thereof and in order from the reflective support:

a blue light sensitive color record comprising a blue light sensitive silver halide emulsion layer comprising a hydrophilic colloid and a yellow dye image forming color coupler, a first non-light sensitive interlayer comprising a hydrophilic colloid, a green light sensitive color record comprising a green light sensitive silver halide emulsion layer comprising a hydrophilic colloid and a magenta dye image forming color coupler, a second non-light sensitive interlayer comprising a hydrophilic colloid, and one or more acrylic latex polymers having a glass transition temperature ($T_g$) of less than 0° C., and a red light sensitive color record comprising a light sensitive silver halide emulsion layer comprising a hydrophilic colloid and a cyan dye image forming color coupler.

2. The color photographic element of claim 1, wherein the blue light sensitive color record comprises a single blue light sensitive silver halide emulsion layer, the green light sensitive color record comprises a single green light sensitive silver halide emulsion layer, and the red light sensitive color record comprises a single light sensitive silver halide emulsion layer.

3. The color photographic element of claim 1, wherein the acrylic latex polymer is present in the second non-light sensitive interlayer in an amount of at least 20 mg/m$^2$ to and including 2,000 mg/m$^2$.

4. The color photographic element of claim 1, wherein the acrylic latex polymer in the second non-light sensitive interlayer has a glass transition temperature ($T_g$) of at least −80° C. and less than 0° C.

5. The color photographic element of claim 1, wherein the acrylic latex polymer in the second non-light sensitive interlayer comprises recurring units derived from:

(a) at least one acrylate monomer having an alkyl ester group having 2 to 10 carbon atoms, (b) an ethylenically unsaturated polymerizable monomer having a pendant sulfo or oxysulfo group or salt thereof, and (c) optionally, an acetoacetoxy acrylate or acetoacetoxy methacrylate.

6. The color photographic element of claim 5, wherein the acrylic latex polymer in the second non-light sensitive interlayer comprises at least 80 mol % of recurring units derived from one or more (a) group monomers, at least 4 mol % of recurring units derived from one or more (b) group monomers, and optionally at least 2 mol % of recurring units derived from one or more (c) group monomers, all based on the total recurring units in the polymer.

7. The color photographic element of claim 5, wherein the acrylic latex polymer in the second non-light sensitive interlayer comprises at least 85 mol % to and including 95 mol % of recurring units derived from one or more (a) group monomers, at least 4 mol % to and including 7 mol % of recurring units derived from one or more (b) group monomers, and at least 2 mol % to and including 6 mol % of recurring units derived from one or more (c) group monomers, based on the total recurring units in the polymer.

8. The color photographic element of claim 1, wherein the second non-light sensitive interlayer further comprises a high boiling organic coupler solvent in an amount greater than 100 mg/m$^2$.

9. The color photographic element of claim 8, wherein the high boiling coupler solvent is one or more carbonamides, phosphates, phenols, alcohols, or esters.

10. The color photographic element of claim 1, wherein the first non-light sensitive interlayer further comprises a high boiling organic coupler solvent in an amount of at least 100 mg/m$^2$.

11. The color photographic element of claim 10, wherein the first non-light sensitive interlayer further comprises an acrylic latex polymer having a glass transition temperature ($T_g$) of at least −50° C. to and including −10° C.

12. The color photographic element of claim 1, wherein the dry weight ratio of the hydrophilic colloid to the one or more acrylic latex polymers in the second non-light sensitive interlayer at least 2.25:1 to 12:1.

13. The color photographic element of claim 1, wherein each of the blue light sensitive silver halide emulsion layers, green light sensitive silver halide emulsion layers, and red light sensitive silver halide emulsion layers comprise the same or different silver halide grains comprising at least 95 mol % chloride, based on the total grain silver.

14. The color photographic element of claim 1, wherein each of the blue light sensitive silver halide emulsion layers, green light sensitive silver halide emulsion layers, and red light sensitive silver halide emulsion layers comprise the same or different silver halide grains comprising at least 90 mol % chloride, and up to 2 mol % of iodide, both based on the total grain silver.

15. The color photographic element of claim 1, wherein:

the blue light sensitive color record comprises a single blue light sensitive silver halide emulsion layer comprising a gelatin as the hydrophilic colloid, one or more yellow dye image forming color couplers, and silver halide grains having at least 95 mol % chloride and up to 2 mol % of iodide, based on the total grain silver, the green light sensitive color record comprises a single green light sensitive silver halide emulsion layer comprising a gelatin as the hydrophilic colloid, one or more magenta dye image forming color couplers, and silver halide grains having at least 95 mol % chloride and up to 2 mol % of iodide, based on the total grain silver, and the red light sensitive color record comprises a single red light sensitive silver halide emulsion layer comprising gelatin as the hydrophilic colloid, one or more cyan dye image forming color couplers, and silver halide grains having at least 95 mol % chloride and up to 2 mol % of iodide, based on the total grain silver.

16. A method for providing a color photographic print, comprising:

imagewise exposing the color photographic element of claim 1 to provide an imagewise exposed color photographic element having a latent color positive image, and developing, bleach-fixing, and rinsing the imagewise exposed color photographic element to provide a color positive image from the latent color positive image.

17. The method of claim 16 further comprising assembling the color positive image into a photobook, with or without other color positive images.

18. The method of claim 16, further comprising electronically transmitting or displaying the color positive image.

19. The method of claim 16, wherein the color photographic silver halide element, further comprises in the second non-light sensitive interlayer, a high boiling organic coupler solvent in an amount greater than 100 mg/m$^2$.

20. A method for providing a color photographic print, comprising:

imagewise exposing the color photographic element of claim 15 to provide an imagewise exposed color photographic element having a latent color positive image, and developing, bleach-fixing, and rinsing the imagewise exposed color photographic element to provide a color positive image from the latent color positive image, wherein in the color photographic element, the dry weight ratio of the hydrophilic colloid to the one or more acrylic latex polymers in the second non-light sensitive interlayer at least 2.25:1 to 12:1, and the second non-light sensitive interlayer further comprises a high boiling organic coupler solvent in an amount greater than 100 mg/m$^2$.

* * * * *